US007841793B2

(12) United States Patent
Ramet

(10) Patent No.: US 7,841,793 B2
(45) Date of Patent: Nov. 30, 2010

(54) DEVICE FOR PACKAGING AND APPLYING A COSMETIC PRODUCT

(75) Inventor: Marc Ramet, Asnieres (FR)

(73) Assignee: L'oreal, Paris (FR)

( * ) Notice: Subject to any disclaimer, the term of this patent is extended or adjusted under 35 U.S.C. 154(b) by 925 days.

(21) Appl. No.: 11/298,598

(22) Filed: Dec. 12, 2005

(65) Prior Publication Data

US 2007/0081848 A1 Apr. 12, 2007

Related U.S. Application Data

(60) Provisional application No. 60/640,173, filed on Dec. 30, 2004.

(30) Foreign Application Priority Data

Dec. 10, 2004 (FR) ..... 04 52920

(51) Int. Cl.
*A46B 11/00* (2006.01)

(52) U.S. Cl. ..... 401/11; 401/183; 401/265; 132/320

(58) Field of Classification Search ..... 401/11, 401/265, 266, 183–186; 132/285, 320, 216, 132/217

See application file for complete search history.

(56) References Cited

U.S. PATENT DOCUMENTS

| | | | | |
|---|---|---|---|---|
| 2,328,973 | A * | 9/1943 | Goldfisher | 401/11 |
| 3,088,470 | A * | 5/1963 | Hall | 401/11 |
| 4,370,989 | A | 2/1983 | Taylor | |
| 5,937,873 | A | 8/1999 | Schlosser et al. | |
| 6,508,255 | B1 | 1/2003 | Glover et al. | |
| 6,601,591 | B1 | 8/2003 | Carullo et al. | |
| 2002/0007839 | A1 | 1/2002 | Gueret | |
| 2004/0161285 | A1 | 8/2004 | Gueret | |

FOREIGN PATENT DOCUMENTS

| | | |
|---|---|---|
| EP | 1 440 629 | 7/2004 |
| FR | 2 412 287 | 7/1979 |
| FR | 2 633 256 | 12/1989 |

* cited by examiner

*Primary Examiner*—David J Walczak
(74) *Attorney, Agent, or Firm*—Oblon, Spivak, McClelland, Maier & Neustadt, L.L.P

(57) ABSTRACT

A device for packaging and applying a cosmetic product includes a container holding the product. The container opens out via a product delivery passage into at least one opening surrounded by an outwardly concave surface designed to bear against a surface to be treated. The bearing surface is delineated by a continuous outer edge of elongated shape, of which the tangent at the level of the deepest portion forms an angle greater than 45° with the lengthwise axis of the product delivery passage. The opening facilitates the application of product on a surface to be treated, in the form of at least one predetermined motif.

40 Claims, 3 Drawing Sheets

DEVICE FOR PACKAGING AND APPLYING A COSMETIC PRODUCT

CROSS-REFERENCE TO RELATED APPLICATIONS

This document claims priority to French Application No. 0452920, filed Dec. 10, 2004, and U.S. Provisional Application No. 60/640,173, filed Dec. 30, 2004, the entire contents of which are hereby incorporated by reference.

BACKGROUND OF THE INVENTION

1. Field of the Invention

This invention relates to a device for packaging a product and configured to apply the product to the skin. The product can be a cosmetic product.

2. Discussion of Background

The expression "cosmetic product" is understood to mean a product such as defined in Council Directive 93/35/CEE dated 14 Jun. 1993, amending Directive 76/768/CEE for the sixth time.

The product applied using the device according to the invention is preferably fluid, and particularly in liquid or paste form.

In a preferred embodiment, the invention relates to a device for applying a makeup product in the form of a motif such as a line, particularly to the edge of the eyelids. The product in this case can be a cosmetic eye-liner composition. Such compositions can be applied to the edge of the eyelids in the form of a thin layer resulting in the formation of a film once it has dried.

To draw a line on the edge of the eyelids, it is known to use make-up pencils. It is also known to use devices that include a reservoir containing a liquid product and an applicator equipped with a flexible applicator element to apply the product. Such devices are described for example in patent applications FR-A-2 633 256, FR-A-2 412 287 and U.S. Pat. No. 4,370,989. In this type of device, the applicator element takes the form of a wand which can be covered in flock material or felt to hold the product, or by a wand which includes capillary grooves also designed to hold the product. The applicator element can also be in the form of a brush. When the device is in the closed position, the applicators are immersed in the reservoir so as to be loaded with product. The applicator wand may also be fed with product from the container by squeezing the walls of the container. To draw a line on her eyelid, the user applies the wand loaded with product to one side of the eyelid and moves it to the other side thereby drawing a line in the same manner as with a pencil.

However, with such applicator elements, it can be difficult to draw an even line, particularly of a constant thickness over the full length of the line. In effect, the user tends to apply more or less pressure on the applicator as she is drawing the line so that the tip is pressed more or less strongly against the eyelid. Consequently, the width of the applicator tip applied to the eyelid, and therefore that of the drawn line, vary. In the case of a brush, it can also be difficult to obtain a fine line that is also even.

Furthermore, it can also be difficult to draw an identical line on both eyelids as the user does not perform precisely the same hand gesture to draw a line on the two eyelids. She is in effect obliged either to change hands for each eyelid, which requires her to use one hand with which she is less adept, or to use the same hand for both eyelids and to perform two different movements. Here again, in performing a different hand gesture for each eyelid, the user will tend not to press on the applicator tip or brush in precisely the same way for the two eyelids.

Moreover, the eyelid being a highly flexible surface, it tends to crease when the applicator tip is drawn across it with sufficient pressure to deposit the product. It can then be difficult to draw a continuous line on a creased surface.

Other types of applicators have been described for the application of eye-liner compositions to the eyelids using other hand actions.

For example, document U.S. Pat. No. 6,508,255 describes a cosmetic applicator designed to apply a product available on an applicator element to a surface to be coated, in particular to an eyelid. The applicator element is flexible and extends between two arms carried by a handle. The applicator element defines an application surface which is applied directly against the eyelid and flexes as it does so, thereby drawing the entire line in a single application.

Document U.S. Pat. No. 5,937,873 describes a cosmetic product applicator designed to apply the product to a surface to be coated in the manner of a pad. The application surface of the applicator is of convex shape. The application surface is fed with product, either by drawing the product from a reserve of product, or via delivery channels which emerge at the application surface and which lead from a product reserve connected to the applicator. The coated application surface is applied against the surface to be coated pivoting the applicator on the surface to be coated.

Document U.S. Pat. No. 6,601,591 describes a cosmetic product applicator which, having taken up a quantity of product, applies the product in the manner of a pad. The applicator includes several application surfaces of different shapes designed to adapt to different surfaces to be coated.

Also, document US2002/0007839 describes an applicator used to apply a surface coating of product to the lips or the eyelids for example. The applicator includes a tip of which the end surface is flocked and into which emerges a circular delivery conduit for the product. Such an applicator is not configured to apply a precise motif to the edge of an eyelid.

Document EP1 440,629 also describes a cosmetic product applicator wherein the product is held by capillary action between two walls forming a cavity between them. The cavity opens out via two slots, one being provided to allow the product to return to the cavity and the other, less wide, being provided to dispense the product. The applicator is fed with product either by drawing the product from a product reserve, or via a delivery channel which emerges at one end of the walls, and therefore of the slots, and which leads from a product reserve connected to the applicator. The cavity is thus loaded progressively between its two ends so that the product arrives progressively along the applicator slot. Here again, such an applicator is not configured to apply a precise motif to the edge of an eyelid.

SUMMARY OF THE INVENTION

Thus, one of the objects of the invention according to a preferred embodiment is to provide a device for applying a makeup product which enables a motif to be drawn on an eyelid in a rapid and highly precise manner using a simple hand gesture.

Another object of the invention according to a preferred embodiment is to provide such a device enabling a relatively fine line to be drawn that is also even over its full length.

A further object of the invention according to a preferred embodiment is to provide a device enabling motifs of varied shapes to be readily drawn.

According to a preferred embodiment of the invention, these objects can be achieved by providing a device for packaging and applying a cosmetic product, in particular a makeup product for the eyelids, including a container holding the product. The container can open out, via a product delivery passage, into at least one opening surrounded by an outwardly concave surface designed to bear against a surface to be treated. The bearing surface can be delineated by a continuous outer edge of elongated shape, of which the tangent at the level of the deepest portion can form an angle greater than 45° with the lengthwise axis of the product delivery passage. The opening(s) can facilitate the application of product on a surface to be treated, in the form of at least one predetermined motif.

The concavity of the bearing surface can allow the device to be steadied on the eyelid before causing the product to emerge so that the user can readily dispense the product without moving the bearing surface on the eyelid. The user can also repeat this action several times to correctly position the device on the eyelid before causing the product to emerge, without any product being deposited on the eyelid.

In the embodiment in which the tangent to the outer edge, at the level of the deepest portion, forms an angle greater than 45° with the lengthwise axis of the product delivery passage, or greater than 60° or equal to 90°, the product dispensed from the container via the inlet passage can arrive substantially at the same time along the entire opening surrounded by the outer edge. A substantially uniform quantity can thus be applied along the entire opening.

The motif can be determined by the shape of the opening. The motif can thus be readily drawn on an eyelid using a simple hand gesture, which is to place the bearing surface against the eyelid without the user having to move the bearing surface relative to the eyelid because the opening is already in the shape of the motif to be drawn.

The opening can have a generally elongated shape. The opening can for example be in the shape of a straight or curved slot, a wave shape or a zigzag shape.

The opening can have a constant width or a variable width over its full length.

The container can open out via two mutually parallel elongated openings, and the two openings can be of identical or different shape.

The container can also open out via several openings formed consecutively in a line which can be straight or curved. The openings can have a cross-section chosen from circular, oval, triangular, polygonal, or star-shaped cross-sections. All of the openings can be of identical cross-section. Alternatively, at least two of the openings can have a different cross-section.

The container can be elongated on a lengthwise axis X, the opening(s) being formed at one axial end of the container. The bearing surface can be elongated on an axis Y substantially perpendicular to the axis X of the container.

The container can include a body with a deformable wall, in particular resiliently deformable, so as to reduce the internal volume of the container in order to cause the product to emerge through the opening.

The device can additionally include an applicator element incorporating an application surface, in particular concave, designed to pass through the opening(s) so as to apply the product by contact to the surface to be treated, the motif(s) being determined by the projection of the application surface. Here again, the motif can be readily drawn on an eyelid using a simple hand gesture given that the application surface of the applicator element has the shape of the motif to be drawn.

The applicator element can be a porous or fibrous element designed to absorb the product and to dispense it through the opening(s) onto the surface to be treated. In particular the applicator element can be made of a material selected from cellular materials, particularly foams or agglomerates, and textile fibres.

All of the product can be contained in the applicator element so that a relatively liquid product can be applied without risk of leakage of the product.

The applicator element can be fixed inside the container.

In a particular embodiment, the part of the container equipped with the bearing surface can be mobile relative to the rest of the container, the mobile part being designed to slide relative to the rest of the container in response to pressure exerted on the bearing surface, so that it moves downward until the application surface of the applicator element passes through the opening(s). The device can include resilient means of return designed to restore the mobile part of the container to its initial position when the pressure exerted on the bearing surface is relaxed.

The invention also relates to a makeup method for the skin which includes the following steps:

providing a device such as that just described, placing the bearing surface on the skin, in particular on the eyelid, and in particular on the edge of the eyelid, causing the product to emerge through the opening so as to deposit the product on the skin in the form of a predetermined motif, in particular by deforming the wall of the container body to expel the product, or sliding the mobile part of the container relative to the rest of the container so that the application surface of the applicator element passes through the opening(s).

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

Other characteristics and advantages of the invention will become apparent from the following detailed description, particularly when considered in conjunction with the drawings in which.

DETAILED DESCRIPTION OF THE PREFERRED EMBODIMENTS

Figure 1:
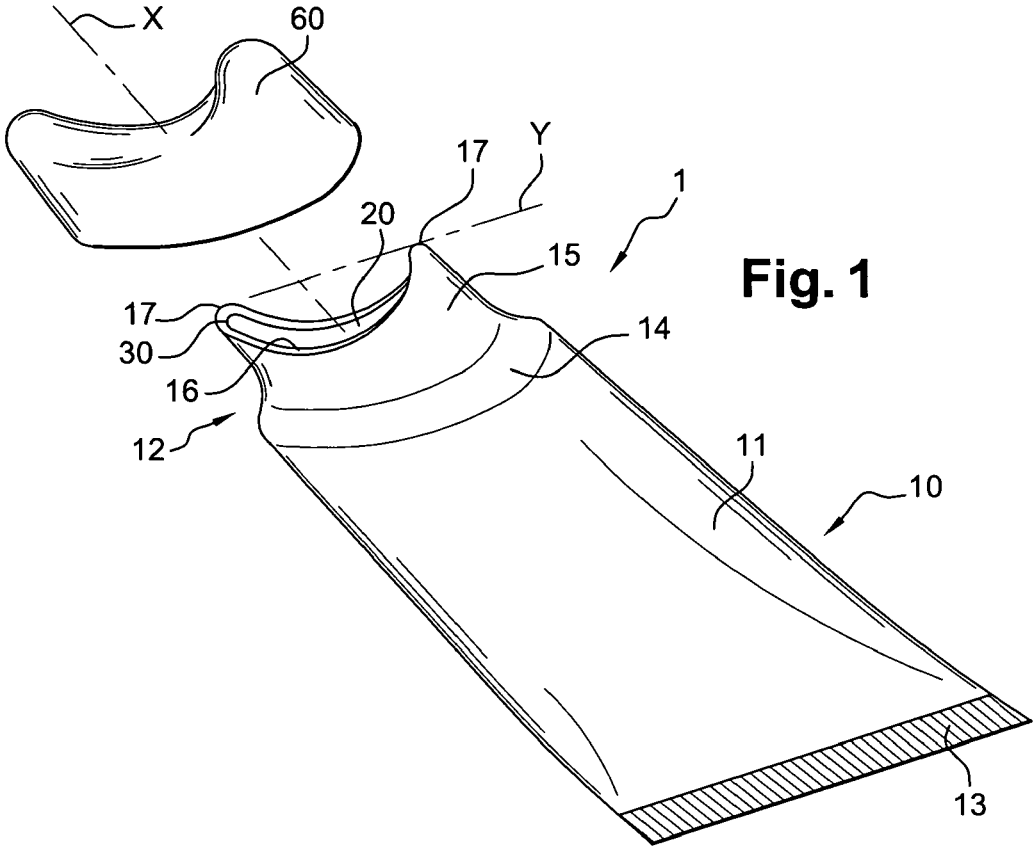
FIG. 1 illustrates a perspective view of a first embodiment of a device according to the invention.
Figure 2:
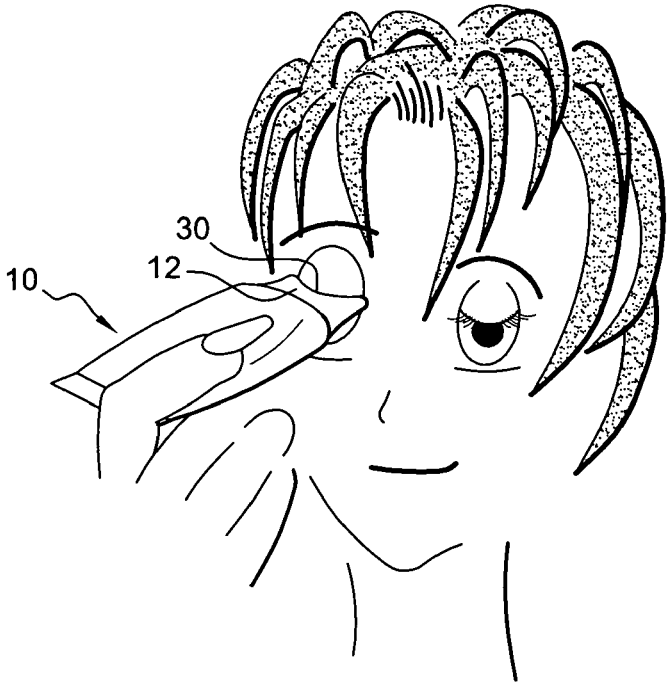
FIG. 2 shows the device in FIG. 1 in the process of being used.
Figure 3:
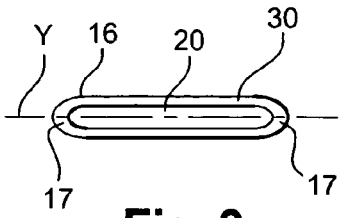
FIG. 3 illustrates a top view of the device in FIG. 1.

FIGS. 1 and 2 depict an example of a packaging and applicator device 1 including a container 10 which holds a cosmetic product and in particular a makeup product, such as an eye-liner composition for example, designed to be applied to the edge of an eyelid. In this example, the eye-liner composition can have a relatively paste-like consistency.

In this first embodiment, the container 10 is in the form of a tube which includes a body 1, having a resiliently deformable wall, elongated on a lengthwise axis X of which the transverse cross-section is substantially oval. The body 11 is provided with a dispensing head 12 at a first axial end. The body 11 is closed at a second axial end, opposite the first, along a closure line 13 extending substantially perpendicular to the axis X. The body 11 is for example closed at the end opposite the dispensing head 12 along a closure line 13.

The scope of the invention is not exceeded by providing a tube wherein the body can have a cross-section other than oval, in particular round, elliptical, or polygonal, for example triangular or square.

The dispensing head 12 includes a neck 15 connected to the first axial end of the body by a shoulder 14, the neck opening out via an opening 20 enabling the product to be applied to an eyelid in the form of a motif determined by the shape of the opening 20. The neck 15 thus forms a product delivery passage leading from the container to the opening 20. The upper edge 16 of the neck which surrounds the opening additionally delineates a concave bearing surface 30 the function of which will be explained later in the description.

Figure 4:
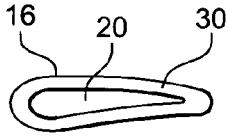
FIGS. 4 to 12 illustrate alternative embodiments of the bearing surface and the opening of the device.
Figure 9:
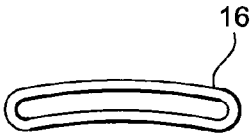
Figure 12:
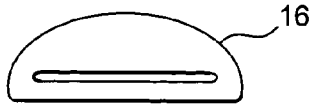

In the example illustrated in FIG. 1, the neck 15 includes a sidewall which extends parallel to the axis X of the container and the transverse cross-section of which is elongated on an axis Y, perpendicular to axis X. In particular, the transverse cross-section of the neck has two long rectilinear sides, parallel to the axis Y, which are joined at their ends 17 by rounded edges. As a variant, the two long sides can be curved as depicted in FIG. 9. As a further variant, the neck 15 can have an almond shaped or half-moon shaped transverse cross-section, as depicted for example in FIGS. 4 and 12. The neck can have a transverse cross-section of any other shape.

The height of the neck 15 measured on the axis X varies between two maximum positions located at each end 17 of the long sides of the sidewall of the neck, passing through a minimum position situated at the midpoint between the two maximum positions thereby forming the concave bearing surface 30. As can be seen in FIG. 1, the bearing surface 30 is delineated by the continuous outer edge 16, of which a tangent at a level of a deepest portion forms an angle greater than 45° with the lengthwise axis X of the product delivery passage.

Figure 8:
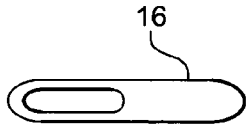

In the example illustrated in FIG. 1, the neck opens out via a single opening 20, of elongated shape on the axis Y thereby forming a straight slot configured to draw a motif in the form of a straight line. In particular, the slot extends between each end 17 of the long sides of the neck so as to be capable of drawing a line on the entire edge of an eyelid. The slot 20 has a length of between 25 and 35 mm for example. Alternatively, the slot can extend only over part of the transverse cross-section of the neck, for example over half of its transverse cross-section, as illustrated for example in FIG. 8. Such a slot enables a line to be drawn on half of the eyelid.

In the example illustrated in FIGS. 1 and 2, the slot has a constant width over the whole of its length. As a variant, the elongated opening can have a variable width along its length, as illustrated for example in FIG. 4.

Figure 10:
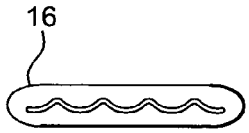
Figure 11:
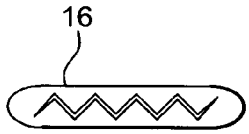

In other variants illustrated respectively in FIGS. 9, 10 and 11, the elongated opening can be in the form of a curved slot, a wave shape or a zigzag shape.

Figure 6:
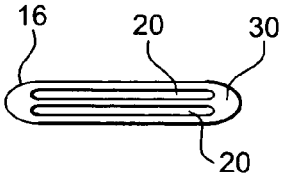

The container can also open out via several openings. In particular it can open out via two mutually parallel elongated openings, for example via two straight slots as illustrated in FIG. 6. Such openings make it possible to draw two lines on the eyelid, one above the other. In the example shown, the two slots are of identical shape but they may also have a different shape.

Figure 5:
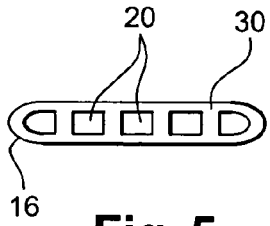
Figure 7:
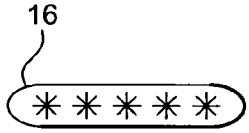

In another variant, the container can open out via several openings extending in a consecutive manner on a line. For example, a plurality of square-shaped openings can be aligned in a straight line, as depicted for example in FIG. 5. It is also possible to provide a plurality of star-shaped openings aligned in a straight line, as illustrated in FIG. 7.

The slot 20 can be closed off in a leaktight manner by a cap 60. The cap 60 can be friction fitted onto the external wall of the neck 15.

To make the device just described, the head 12, made by plastic injection moulding for example, can be welded to the upper end of the body 11 of the tube which can itself be formed from a cylindrical plastic skirt. After filling the container body with the eye-liner composition, the end of the skirt opposite the dispensing head can be heat-sealed using a clamping tool, thereby welding the inner surface of the skirt to itself to form the closure line 13. Preferably, the tube is made of polyethylene or another similar thermoplastic material. It can also be made of aluminium or tin. In the latter case, the rectilinear bottom can be obtained by folding. Where appropriate, the body 11 can be made of a multi-layer structure, for example plastic/metal/plastic.

To apply the product to the eyelid, the concave bearing surface 30 can be placed on the eyelid, as illustrated in FIG. 2, at the point where it is desired to draw a line of eye-liner. The device can thus be steadied on the eyelid before dispensing the product. In this steady position, the product can be readily dispensed. To this end, pressure can be exerted on the resiliently deformable wall of the tube body 11 so as to reduce the volume of the internal space of the tube body 11 and to bring the eye-liner paste composition contained in the tube 10 into the slot and therefore onto the eyelid. The eye-liner composition is thus expelled from the container over the full length of the slot thereby drawing a line directly on the eyelid.

Figure 13:
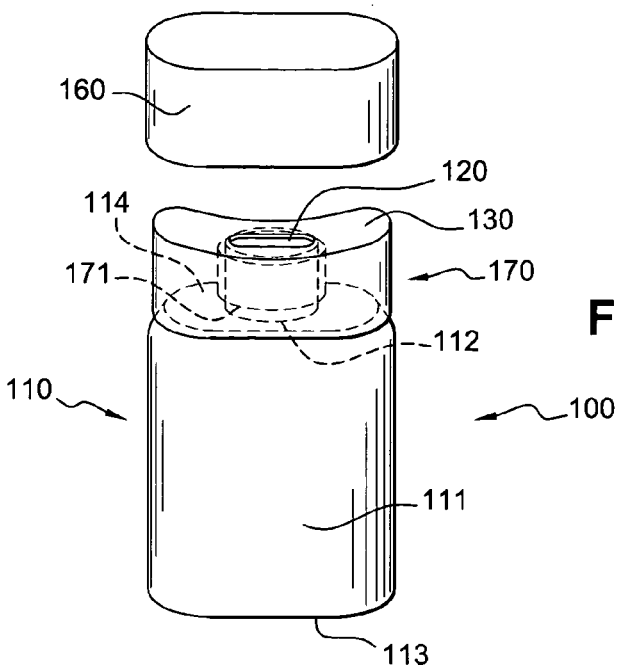
FIG. 13 illustrates a second embodiment of a device according to the invention.

In a second embodiment illustrated in FIG. 13, the device 100 includes a container 110 in the form of a bottle. The container can include a tubular body 111 which includes, at a first end, a transverse wall 114 from which extends an open neck 112 of circular transverse cross-section. The tubular body is closed at a second end opposite the first, by a transverse wall forming a bottom 113.

A head 170 is designed to be mounted on the neck of the bottle, for example by screwing or snap-on attachment. To this end, the head includes a fixing skirt 171 designed to be attached to the neck. The head includes a transverse wall 130 of concave shape wherein a slot-shaped opening 120 is formed. The transverse wall 130 forms a bearing surface designed to conform to the shape of an eyelid.

As in the previous embodiment, the head can have a transverse cross-section of different shapes. In addition, one or more openings such as those depicted in FIGS. 3 to 12 can be formed in the transverse wall 130.

A cap 160 can additionally be provided for mounting on the head, for example, by snap-on attachment or friction fit, thereby closing off the slot. As a variant, a cover can be pivoted on the head, for example, by a film hinge or by a spring-effect toggle hinge.

Figure 14:
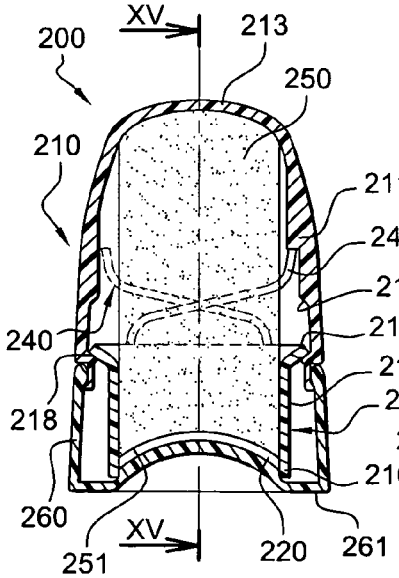
FIGS. 14 to 16 illustrate a third embodiment of a device according to the invention.
Figure 15:
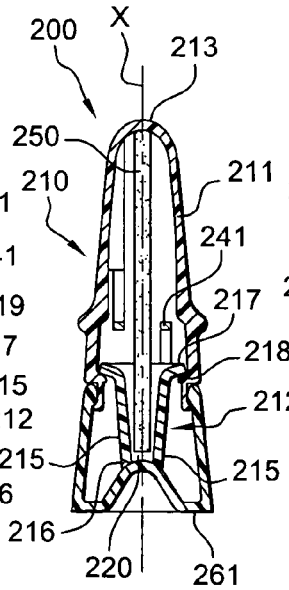
Figure 16:
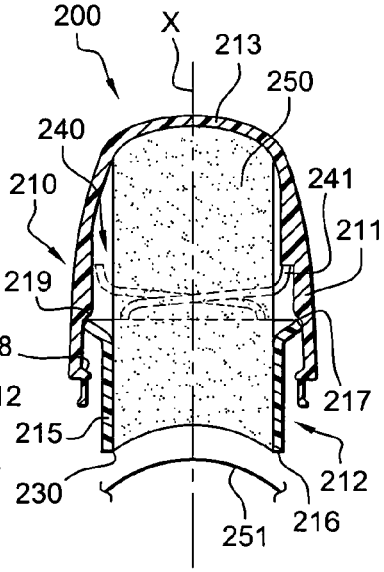

FIGS. 14 to 16 illustrate a third embodiment of a packaging and applicator device 200 according to the invention wherein the container 210 contains a relatively liquid eye-liner composition.

In this embodiment, the container 210 includes a body 211 formed by a rigid wall. However, the scope of the invention is not exceeded by providing a body which includes a deformable wall, even if the deformation is not necessary to expel the product.

The body 211 is elongated on a lengthwise axis X of which the transverse cross-section is substantially oval. The body 211 is closed at a first axial end by an outwardly domed bottom 213. The body 211 is open over its entire cross-section at its second axial end, opposite the first, so as to receive a dispensing head 212 which, in this instance, is mobile relative to the body 211.

The dispensing head 212 includes a skirt 215 forming a product delivery passage, of substantially oval cross-section, with two rectilinear and mutually parallel long sides. The upper edge 216 of the skirt 215 forms a concave bearing surface 230, configured to conform to the shape of an eyelid. The upper edge 216 additionally delineates a slot-shaped opening 220 of constant width over its entire length.

The lower edge of the skirt 215 is provided with a lip 217 designed to slide along the inner wall of the body 211. The dispensing head 212 is held inside the body by means of a projection 218 provided on the inner wall of the body 211, at its second end. Downward movement of the head 212 is also limited by a flange 219 forming a stop, also formed on the inner wall of the body 211, at a sufficient distance from the projection to allow the dispensing head to travel the desired distance, as will be seen in the remainder of the description.

Resilient means of return 240 are additionally provided so that, when no pressure is being applied on the applicator head, the latter is held abutted against the projection 218. In the example shown, the resilient means of return are formed by two resilient tabs 241 connected respectively to the dispensing head 212 and to the body of the container 210.

The container 210 additionally includes an applicator element 250 designed to absorb the liquid product and to deposit it on the eyelid by contact.

In particular, the applicator element can be a block of open-cell foam. The applicator element 250 is impregnated with the liquid eye-liner composition. As the composition is absorbed into the foam, it cannot flow out of the container. Alternatively, the applicator element 250 can be composed of a felt or any other fibrous material designed to absorb the product.

The applicator element 250 includes an application surface 251 configured to pass through the slot so as to come into contact with the eyelid and to impress a motif thereon. The application surface 251 is preferably concave so that it can conform to the shape of an eyelid in order to impress a motif thereon without moving it across the eyelid. In this embodiment, the motif is determined, not by the shape of the opening, but by the projections of the application surface 251. The application surface 251 can be devoid of projections so as to form a straight line. As a variant, different projections may be provided along the application surface 251 in order to impress patterns matching the projections.

The foam block 250 can be of generally parallelepipedic shape. It can be fixed inside the body 210, and in particular to the bottom 213 of the body. It can be pinched between two ribs provided on the inner wall of the body 210.

The foam block preferably has a sufficiently short length measured on the axis X so that, when the dispensing head 212 is not depressed, the application surface 251 of the applicator element is inside the container, in particular at some distance from the slot 220. The foam block nevertheless preferably is of sufficient length so that, when the dispensing head is depressed, the application surface 251 is able to pass through the slot to come at least level with the bearing surface 230, or beyond it.

As in the previous embodiments, the applicator head can open out via one or more openings such as those depicted in FIGS. 3 to 12. Depending on the shape of the opening(s), the shape of the end of the foam block forming the application surface 251 can be adapted so that the latter is able to pass through the opening(s).

The slot 220 can be closed off in a leaktight manner by a cap 260 arranged to attach to the open rim of the container body. The cap includes a surface 261 which extends transversely to the axis X and which enables it to stand in a stable manner on a flat surface.

The fact that the bottom 213 of the container body is domed means that it cannot stand in a stable manner on a flat surface. The user can thus store the device 200 by placing the surface 261 of the cap on a flat surface so that the slot 220 is facing downward, as illustrated in FIGS. 14 and 15. The product then has a tendency, in particular when only a small quantity is left, to impregnate the portion of the foam block located in proximity to the slot, so that the device is ready for use as soon as the cap is removed.

To apply the product, the concave bearing surface 230 of the device is placed on the eyelid while holding the body 211 of the container. The device can thus be steadied on the eyelid before dispensing the product. In this steady position, the product can then be readily dispensed from the container in order to deposit it on the eyelid without moving the bearing surface across the eyelid. To this end, the device can be moved towards the eyelid so that pressure is exerted on the bearing surface 230. The dispensing head 212 then slides into the body 210 until the application surface 251 of the foam block passes through the slot and comes level with the bearing surface, as illustrated in FIG. 15. The eye-liner composition is thus deposited on the eyelid in the form of a line.

The device can then be moved away from the eyelid which relaxes the pressure exerted on the bearing surface 230. The dispensing head 212 is then restored to its initial position by the resilient return action of the two resilient tabs 241.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A device for packaging and applying a cosmetic product, comprising:

a container to hold said cosmetic product, the container configured to dispense said product via a product delivery passage into at least one opening surrounded by a continuous outer edge of an outwardly concave bearing surface, of which a tangent at a level of a deepest portion forms an angle greater than 45° with a lengthwise axis of the product delivery passage, said at least one opening being in the form of at least one predetermined motif to apply the cosmetic product, wherein the container is elongated on a lengthwise axis X, the opening and the continuous outer edge being formed at an axial end of the container, the continuous outer edge and the at least one opening are elongated on an axis Y substantially perpendicular to the axis X of the container, and the opening is non-linear at least substantially between a first end and a second end.

2. The device according to claim 1, wherein the tangent to the outer edge, at the level of the deepest portion, forms an angle greater than 60° with the lengthwise axis of the product delivery passage.

3. The device according to claim 2, wherein the tangent to the outer edge, at the level of the deepest portion, forms an angle of about 90° with the lengthwise axis of the product delivery passage.

4. The device according to claim 1, wherein the predetermined motif is determined by a shape of the opening.

5. The device according to claim 1, wherein the opening has a generally elongated shape.

6. The device according to claim 5, wherein the opening has a variable width.

7. The device according to claim 5, wherein the opening is in the shape of a curved slot.

8. The device according to claim 5, wherein the opening is in the shape of a wave.

9. The device according to claim 5, wherein the opening is in the shape of a zigzag.

10. The device according to claim 1, wherein the container includes a body with a deformable wall so as to reduce an internal volume of the container in order to cause the product to emerge through the opening.

11. The device according to claim 10, wherein the wall of the body is resiliently deformable.

12. The device according to claim 1, further comprising an applicator element incorporating an application surface designed to pass through the opening so as to apply the product by contact to a surface to be treated, the predetermined motif being determined by a projection of the application surface.

13. The device according to claim 12, wherein the application surface of the applicator element is concave.

14. The device according to claim 12, wherein the applicator element is a porous or fibrous element configured to absorb the product and to dispense the product through the opening onto the surface to be treated.

15. The device according to claim 12, wherein the applicator element is made of a material selected from a group consisting of cellular materials and textile fibres.

16. The device according to claim 12, wherein all of the product is contained in the applicator element.

17. The device according to claim 12, wherein the applicator element is fixed inside the container.

18. The device according to claim 12, wherein a part of the container equipped with the bearing surface is mobile relative to a rest of the container, the mobile part being designed to slide relative to the rest of the container in response to pressure exerted on the bearing surface so that the mobile part moves downward until the application surface of the applicator element passes through the opening.

19. The device according to claim 18, further comprising resilient means of return to return the mobile part of the container to an initial position when the pressure exerted on the bearing surface is relaxed.

20. The device according to claim 1, wherein the cosmetic product is a makeup product for eyelids.

21. The device according to claim 1, wherein the bearing surface is designed to bear against a surface to be treated.

22. The device according to claim 21, wherein the opening facilitates application of the product on the surface to be treated.

23. The device according to claim 1, wherein the continuous outer edge extends along said axis Y over a length of substantially between 25 mm and 35 mm corresponding to a length of an eyelid.

24. A container for a cosmetic product, comprising:

a body elongated on a lengthwise axis;

a dispensing head provided on said body; and a neck provided on said dispensing head, said neck including a side wall which extends parallel to the lengthwise axis and a transverse cross-section of said neck elongated on a transverse axis substantially perpendicular to said lengthwise axis defining a plurality of openings, and a height of the neck measured on the lengthwise axis being varied such that said neck forms a concave outer surface, wherein said openings have a shape to dispense and apply a cosmetic product to an eyelid through said openings in a form of at least one predetermined motif.

25. The device according to claim 24, wherein the container opens out via two mutually parallel elongated openings.

26. The device according to claim 25, wherein the two openings are of identical shape.

27. The device according to claim 25, wherein the two openings are of different shape.

28. The device according to claim 24, wherein the container opens out via several openings formed consecutively.

29. The device according to claim 28, wherein the openings have a cross-section chosen from the group including circular, oval, triangular, polygonal, and star-shaped cross-sections.

30. The device according to claim 28, wherein all of the openings are of identical cross-section.

31. The device according to claim 28, wherein at least two of the openings are of different cross-section.

32. The container of claim 24, wherein the transverse cross-section of the neck has two sides, substantially parallel to said transverse axis.

33. The container of claim 32, wherein the two sides are joined at their ends.

34. The container of claim 32, wherein said two sides are rectilinear.

35. The container of claim 32, wherein the height of the neck measured on the lengthwise axis varies between two maximum positions located at ends of said two sides.

36. The container of claim 35, wherein the height of the neck passes through a minimum position situated at a midpoint between the two maximum positions.

37. The container of claim 24, wherein said concave outer surface is delineated by a continuous outer edge.

38. A container for a cosmetic product, comprising:

a body elongated on a lengthwise axis;

a dispensing head provided on said body; and a neck provided on said dispensing head, said neck defining an opening, said neck including a side wall which extends parallel to the lengthwise axis and a transverse cross-section of said neck elongated on a transverse axis substantially perpendicular to said lengthwise axis, and a height of the neck measured on the lengthwise axis being varied such that said neck forms a concave outer surface, wherein said opening has a shape to dispense and apply a cosmetic product to an eyelid through said opening in a form of at least one predetermined motif, and the opening extends over substantially half of a length of the transverse cross-section of the neck along the transverse axis.

39. The container of claim 24, wherein the openings are elongated along the transverse axis of the neck.

40. A makeup method for an eyelid comprising the steps of:

placing a bearing surface of a cosmetic product container on the eyelid, the bearing surface being an outwardly concave surface surrounding an opening of a product delivery passage of the container, wherein the bearing surface is delineated by a continuous outer edge of elongated shape, of which a tangent at a level of a deepest portion forms an angle greater than 45° with a lengthwise axis of the product delivery passage, the opening being of a predetermined motif;

deforming a wall of the container in order to expel a cosmetic product; and depositing the product on the eyelid in the form of the predetermined motif.

* * * * *